US011482196B2

(12) United States Patent
Battle

(10) Patent No.: US 11,482,196 B2
(45) Date of Patent: Oct. 25, 2022

(54) FLEXIBLE PITCHED SLIDING KEYBOARD INSTRUMENT AND INTERFACE

(71) Applicant: Clark Battle, Seattle, WA (US)

(72) Inventor: Clark Battle, Seattle, WA (US)

( * ) Notice: Subject to any disclaimer, the term of this patent is extended or adjusted under 35 U.S.C. 154(b) by 0 days.

(21) Appl. No.: 17/488,747

(22) Filed: Sep. 29, 2021

(65) Prior Publication Data

US 2022/0101815 A1 Mar. 31, 2022

Related U.S. Application Data

(60) Provisional application No. 63/084,877, filed on Sep. 29, 2020.

(51) Int. Cl.

| | |
|---|---|
| ***G10C 3/12*** | (2006.01) |
| ***G10C 3/16*** | (2019.01) |
| *G10H 1/34* | (2006.01) |

(52) U.S. Cl.

CPC ..... *G10C 3/12* (2013.01); *G10C 3/16* (2013.01); *G10H 1/346* (2013.01)

(58) Field of Classification Search

CPC ..... G10C 3/12; G10C 3/16; G10H 1/346
See application file for complete search history.

(56) References Cited

U.S. PATENT DOCUMENTS 1,853,630 A * 4/1932 Martenot ..... G10H 1/0551 84/706
1,914,831 A 6/1933 Martenot
2,562,471 A * 7/1951 Martenot ..... G10H 1/055 984/316
3,693,492 A * 9/1972 Ohno ..... G10C 3/12 984/316
3,818,114 A * 6/1974 Okamoto ..... G10H 1/0553 84/629
4,068,552 A * 1/1978 Allen ..... G10H 1/344 84/DIG. 24
4,498,365 A * 2/1985 Tripp ..... G10H 1/344 984/316
5,495,074 A 2/1996 Kondo et al.
5,955,690 A * 9/1999 Yoshinaga ..... G10H 1/344 84/436
6,310,609 B1 * 10/2001 Morgenthaler ... H04M 1/72469 345/169
6,670,535 B2 12/2003 Anderson et al.
6,703,552 B2 * 3/2004 Haken ..... G10H 1/0555 84/718
7,723,597 B1 * 5/2010 Tripp ..... G10H 1/344 84/629
9,711,120 B1 * 7/2017 Pogoda ..... G10H 1/346
2022/0101815 A1 * 3/2022 Battle ..... G10C 3/16

* cited by examiner

*Primary Examiner* — Robert W Horn
(74) *Attorney, Agent, or Firm* — Dickinson Wright, PLLC; Michael E. Noe, Jr.; Nicholas J. Angelocci

(57) ABSTRACT

A musical keyboard interface capable of controlling either a string instrument or synthesizer controller includes a small, consistent keyboard interface that moves with each hand along one or both edges of a stationary ruler. The ruler segments measure the static location of each note in chromatic order. The keys are oriented in length perpendicular to the length of the ruler and each key is as wide as each ruler segment. As the keyboard moves along the ruler and its keys realign with new ruler segments, the keys become able to articulate the notes indicated by their position. The transformation is gradual, smoothly sliding notes and chords in varying magnitudes and directions simultaneously.

20 Claims, 9 Drawing Sheets

FLEXIBLE PITCHED SLIDING KEYBOARD INSTRUMENT AND INTERFACE

FIELD

The present disclosure relates to musical instruments. More particularly, the present disclosure relates to musical instruments with moveable keys.

BACKGROUND

Traditionally an instrument key's main function is to press down and reset when released, articulating a specific note. There have been very few instruments employing keys or keyboards that move in alternative manners. Several patents have been granted that cover keyboards containing keys able to move (in any direction other than up-and-down) for the expressive control of pitch. The first and most notable of these was the Ondes Martenot (U.S. Pat. No. 1,914,831 issued to Maurice Martenot in 1931). The Ondes keyboard only plays one note at a time but allows each note to be slightly vibrated using lateral (side-to-side) key movement of a few millimeters.

A more recent reference in the patent literature regarding moving keyboards is U.S. Pat. No. 4,068,552 issued to Allen in January 1978. In this instrument each key moves longitudinally (parallel to its length) a small degree allowing the player to control various synthesized effects, including pitch transposition. The problem (as admitted in the patent) is that moving each key in this way limits the practical glissando range of any note. It would also appear to require an extraordinary level of manual dexterity to accurately control the positions of each articulated key individually. Also, sliding keys longitudinally results in no visual indication of the currently playing note values.

U.S. Pat. No. 3,693,492 issued to Ohno in 1972 disclosed keys that rocked laterally, thereby electronically controlling the quality of the articulated synthesized notes. In this patent, the lateral position of the keys did not change but merely rocked side-to-side to create various electronic effects. Other similar patents (such as U.S. Pat. No. 5,495,074 issued to Kondo, et. al. in 1996) disclosed alternative embodiments of essentially the same idea. Like the Ondes Martenot and Allen keyboard, this strategy limits the practical range of pitch transformation and provides no visual indication of note values.

Another notable recent patent related to moving keyboards is disclosed in U.S. Pat. No. 6,703,552 issued to Haken in March 2004. This patent is the basis for the Continuum keyboard, a MIDI synthesizer controller with a single touch-sensitive surface instead of multiple mechanical keys. For this device, the player slides her fingers along or across the keyboard surface for various effects, including pitch transposition. Another patent, U.S. Pat. No. 6,670,535 issued to Anderson & Anderson in December 2003 embraces a similar concept using an isometric hexagonal array rather than a linear arrangement of touch surfaces. While these instruments do provide a full range of pitch transposition as well as a visual indication of what notes are playing, they lack the haptic assurance of mechanical keys and are restricted to controlling synthesizers.

In view of the above, improvements can be made to musical instruments and keyboards.

SUMMARY

The musical instrument and human interface disclosed herein may be viewed as the first in a new class of keyboard instruments capable of accurately producing a rarely employed style of harmony—multi-directional chord glissando. The instrument is also capable of producing familiar fixed-pitch harmony, using its sliding capabilities for embellishment.

Chordal glissando is characterized by the sounding of multiple simultaneous notes, where the pitch values of each note are free to smoothly transform in independent directions and magnitudes. One example of multi-directional chord glissando is the THX theme music often played in movie theaters before a film to demonstrate the capabilities and features of the theater's audio system. The instrument and human interface disclosed herein are unique in their capacity to produce this style of harmony uniformly across the entirety of its range. The moving keyboards disclosed herein lend themselves to this expressive capacity.

None of the prior art instruments allow for the entire keyboard to move or slide as an expressive control. Rather, the prior art references require individual keys to be moved by the fingertips, a technique that requires an extraordinary level of manual dexterity to accomplish and provides no visual or logistical feedback on the magnitude of pitch transformation.

The interface disclosed herein is the first instrument that allows one or more entire keyboards to slide, thus preserving their musical interval relationships as they do so. This functionality allows the player to clearly understand the note value and harmonic function of each key before it is articulated. Such an interface allows a logical approach to understanding the transformations involved in multi-directional chord glissando. It also separates the physical concerns of fingertip controlled note articulation and arm controlled keyboard movement. This separation results in a less physically and mentally challenging instrument interface. Put another way, the specific fingers and keys can remain actuated to play particular notes/chords, which can be maintained while allowing sliding actuation of each keyboard simultaneously.

This musical human interface may be implemented either as an electronic instrument controller or as a string instrument.

In one aspect, one or more small, mobile keyboards slide linearly alongside one or both edges of a stationary ruler. Each keyboard's linear slide vector is lateral to the length of its keys. As the keyboard slides, the keyboard smoothly transforms the pitches of any of its articulated notes in a direction and magnitude commensurate with its movement. This allows any set of pitches to be smoothly transformed across the full range of the instrument.

In one aspect, the stationary ruler includes a plurality of segments. The segments on the stationary ruler mark a plurality of sequential note locations. Each segment provides a static visual reference for any adjacent keyboard(s) as the keyboards move and become aligned with various ones of the segments. When the end of a particular key aligns with any segment of the ruler, that key becomes able to play the note indicated on the corresponding segment of the ruler. In one aspect, the ruler is easily replaceable for the exploration of alternate encodings.

Multiple keyboards on opposite (or the same) sides of the ruler allow the pitch transformations to occur in multiple directions and magnitudes simultaneously. The keyboard-ruler interface facilitates the controlled production of multi-directional chord glissando. The sliding keyboard(s) and stationary ruler provide an intuitive map of this harmonic territory. The keyboards and ruler therefore form a human interface that can be used alone as a controller for other instruments or can be used to mechanically control a stringed instrument as disclosed herein.

Various aspects of the instrument and interface disclosed herein may present one or more of the following advantages over other keyboard instruments.

In one example, where traditional stringed keyboard instruments are only capable of producing fixed pitches, embodiments of the instrument disclosed herein allow the production of both fixed and flexible pitches.

Embodiments of the human interface disclosed herein are novel in their ability to control the fluid convergence or divergence of independent chordal elements.

Unlike traditional keyboards, the human interface disclosed herein provides a simple and intuitive way to recognize sliding note values.

Embodiments of the instrument disclosed herein are unique in their ability to produce all of these results using mechanically vibrating strings.

Unlike traditional keyboards, the instrument of the present disclosure presents a consistent player interface to the hands regardless of their position.

The note identification system of traditional keyboards is often permanently encoded into the form and color of the keys. Embodiments of the human interface disclosed herein have the advantage of allowing the player to easily replace the note identification system with any preferred encoding.

Additionally, sliding a small set of mechanical keys over the full range of a keyboard instrument drastically reduces the number of mechanisms required to cover a similar range. This substantially reduces the instrument's size and weight, thereby increasing its portability, maintainability, and affordability.

BRIEF DESCRIPTION OFF THE DRAWINGS

DETAILED DESCRIPTION OF THE INVENTION

With reference to FIGS. 1-9, the human-instrument interface illustrated and described herein is arranged to be operated by the player's hands and arms. Each hand of the player addresses a single small keyboard containing a plurality of keys, preferably no more than its fingers can reasonably stretch. However, it will be appreciated that player hand size naturally varies and that the keyboards may be larger than a particular player's fingers may stretch. The keys have a uniform width, and can be of any length. Like traditional keyboards, the fingers of the player press the keys downward to articulate notes, an release the keys upward to terminate notes.

Figure 1:
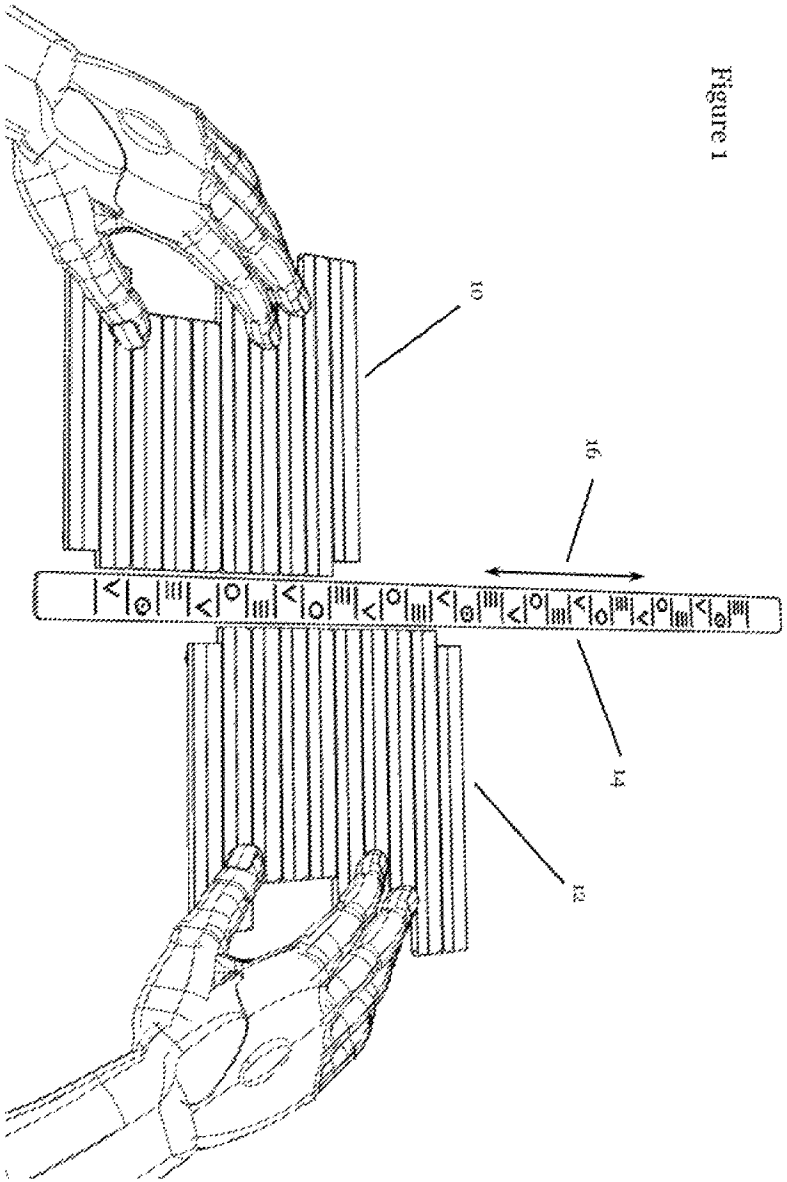
FIG. 1 is a perspective view of a human-instrument interface having a pair of keyboards slidably coupled to a ruler.

Turning to FIG. 1, FIG. 1 shows the human-instrument interface, including two keyboards 10, 12, each composed of a number of parallel keys 20 of uniform width. The keys 20 shown in the figure are V contoured along their length in order to facilitate finger placement and sliding grip, although it will be appreciated no contour is necessary in order to actuate the keys 20 for the operation of the instrument. The contour assists the player in sliding the keyboard 10, 12 along the interface while actuating one or more of the keys 20. Between the keyboards 10, 12 extends a ruler 14, which marks the positions of the notes via a plurality of sectors. Both keyboards 10, 12 are configured to slide along slide vector 16 parallel to the ruler 14. The player's hands are shown upon the keyboards 10, 12 in FIG. 1. The keys 20 are pressed to articulate notes and may also be pushed-and-pulled to move keyboards 10, 12 along a slide vector 16 parallel to the ruler.

Unlike traditional keyboards, there is no single preferred orientation of the hands to the keys 20. While the hands in FIG. 1 are oriented with the fingers approximately perpendicular to the keys, it is also possible to play in the traditional orientation with the fingers generally parallel to the keys 20. It will be appreciated that various methods of actuating the keys 20 by the player may be used.

FIG. 1 illustrates on either side of the ruler 14 according to one aspect of the disclosure. However, in another aspect, it is also possible to have multiple keyboards 10, 12 on the same side of the ruler 14. Such a configuration may lend itself to the more traditional parallel finger-to-key orientation of a traditional fixed keyboard. The sliding movement described herein is applicable to keyboards 10, 12 on both sides of the rule 14, with movement still occurring along vector 16.

The illustrated keyboard configuration tends to lend itself to the illustrated perpendicular finger-to-key orientation. In one aspect, the lengths of the keys 20 may be staggered. However, it will be appreciated that such staggering of the key lengths is optional. The optional staggered key lengths are intended as a way to allow the player's fingertips to reach the keys with their elbows resting comfortably at their sides. In one aspect, other patterns of key lengths may also be used. The arrangement of the various key lengths may be selected based on player preference. Similarly, each key 20 may also be textured or contoured along its length to facilitate keyboard movement. In one aspect, some keys may be textured or contoured, while others are not. The selection of keys 20 that are textured or contoured can likewise be selected based on player preference.

While each key 20 is configured to move up and down to play a note, the entirety of each keyboard 10, 12 is arranged to slide laterally relative to the key lengths (along slide vector 16). This lateral movement (or sliding movement) may be controlled by the player's arms while the player's fingers press and/or pull against the edges of the keys 20. As a keyboard slides in the direction of its higher-pitched keys all of its articulable pitches raise an amount commensurate with the magnitude of its movement. That is, smoothly sliding the keyboard the width of N keys results in a smooth pitch transformation equal to N notes in that direction.

The stationary ruler 14 provides a visual reference for the keyboards' chromatic slide increments. Each uniform segment of the ruler 14 indicates one sequential chromatic note. The width of the keys 20 corresponds to the uniform segment width of the ruler 14. This segment width (and key width) should be wide enough for the player's fingers to confidently isolate one key 20 at a time, but small enough to maximize the range of the instrument given a practical arm reach and finger stretch. The actual size of each key 20 and the corresponding segment of the ruler may be configured based on a particular player, if desired.

In one aspect, while it is possible to permanently attach the ruler 14 to the instrument, the ruler 14 is preferably removable and replaceable. A replaceable ruler 14 would allow for various note identification strategies to be used depending on the desires of the particular player. There are limitless permutations of possible ruler encodings. The illustrated encoding is not intended to imply that it is preferred over any other one, and it will be appreciated by those skilled in the art how such encodings can be tailored to player-preference. In one aspect, the replaceable ruler 14 could be attached by magnets, screws, hook-and-loop fasteners (e.g., Velcro), or a temporary adhesive. The positioning of the ruler 14 relative to the rest of the instrument is apparent in FIG. 9.

In one aspect, the human-instrument interface may be in the form of a remote electronic instrument controller, where the position of each sliding keyboard 10, 12 relative to the ruler 14, having known segment sizes, could be tracked by a linear encoder. Accordingly, combined with an electro-mechanical assembly for detecting key presses, such an arrangement provides sufficient input for an embedded CPU to convert into MIDI or OSC commands for external instrument control. Such CPUs, linear encoders, and electro-mechanical assemblies arranged to detect key presses are known in the art, and will not be described in further detail herein. The sliding arrangement shown and described can therefore be applied to such arrangements to provide similar functionality and control. Thus, as shown in FIG. 1, the keys 20 may be actuated and detected, and the position of the keyboards 10, 12 relative to the ruler 14 may also be detected.

Figure 2:
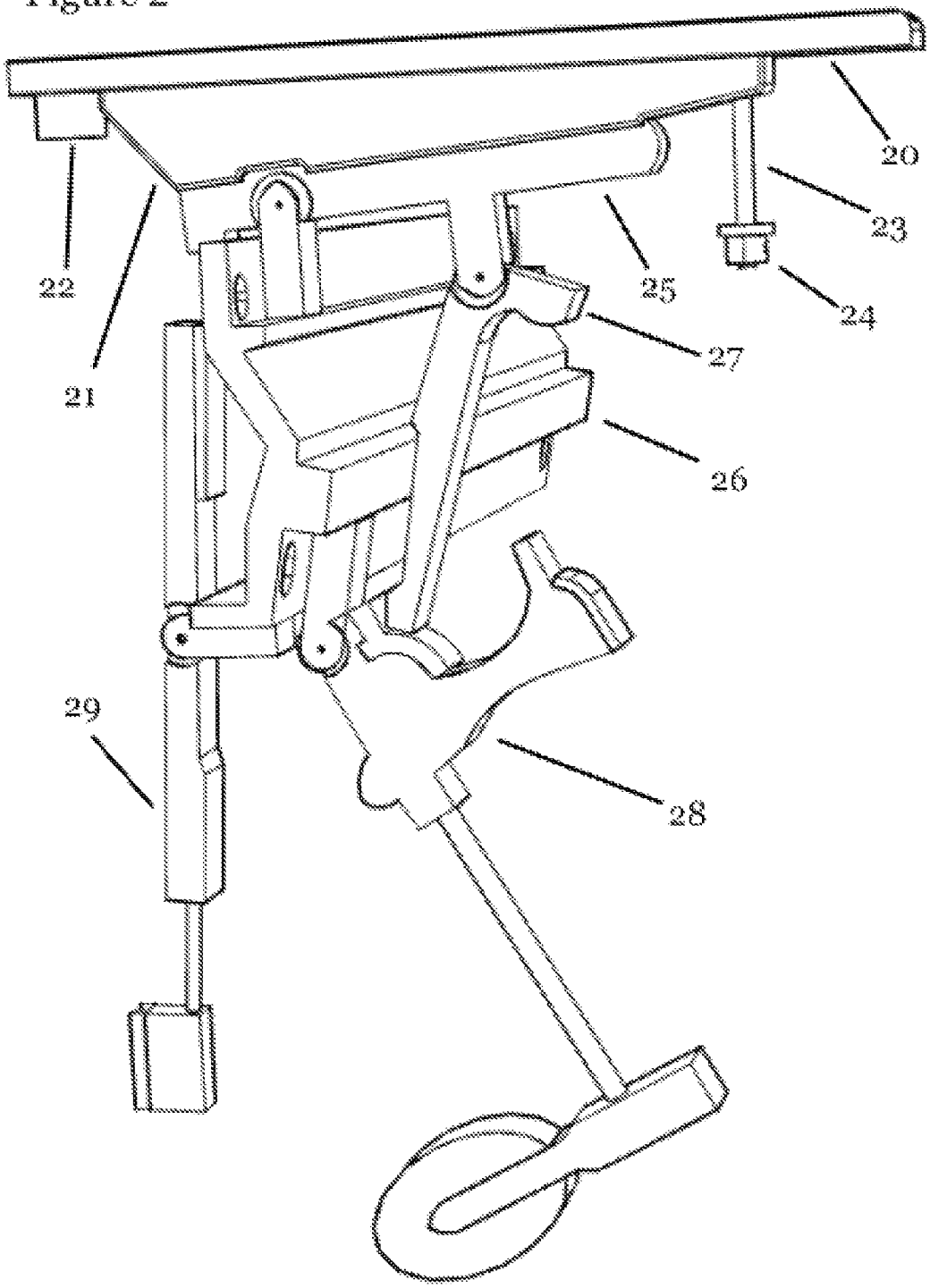
FIG. 2 is a perspective view of one key of the keyboard and a corresponding action mechanism including an action rail.

In one aspect, illustrated throughout the figures, the human interface disclosed may be arranged to control a string-based instrument. Each key 20 may articulate its strings 37 using any existing mechanism for doing so, including clavichord claves, harpsichord quills, piano actions, and electro-mechanical excitement. A piano action mode is detailed herein for reference, but that is not intended to exclude the possibility of other modes of string excitement. Regardless of the method of string excitement, the mechanism and method of pitch transformation upon the strings 37 discussed herein remains the same. FIG. 2, in particular, provides further detailed illustration of a piano action embodiment.

With reference to FIG. 2, a single key 20 is connected to a key-wedge 21, which is attached to the bottom of the key 20. A counter-weight 22, such as a lead counter-weight, is installed at one end of the key 20, adjacent the end of the key wedge 21, to help reset the key 20 when it is released. A key-plunge pin 23 is installed generally vertically into the other end of the key-wedge 21. An adjustable set-screw collar 24 is clamped onto the bottom of the key-plunge pin 23. The key-wedge 21 is generally operable to connect the key 20 to repetition lever 25 of a traditional vertical piano action mechanism, which is oriented with the hammer below the key 20. The action mechanism is installed on an action rail 26, which supports the action mechanism, and which it shares with adjacent action mechanisms (and their supported adjacent keys 20). The action mechanism shown has been limited for clarity to the repetition lever 25, a jack 27, a hammer 28, and a damper lever 29. Other components of a traditional piano action (such as the backcheck, various springs, and the let-off rail) have been omitted from the figure for the sake of clarity. It will be appreciated that this embodiment assumes the presence of a complete and functioning piano action mechanism. Other action mechanisms operable with the keys 20 may similarly be supported by an action rail 26 or the like, and may include other components corresponding to the particular action mechanism.

The modern vertical piano action, illustrated herein, generally works well upside-down, as long as the sustain pedal is sacrificed. However, alternative strategies to control the volume envelope may be included in other embodiments, but are not discussed herein.

In one aspect, orienting the repetition lever 25 above the other components allows the lever 25 to be activated by the key 20 without other interposed moving linkages, thereby resulting in a more direct manual control of the associated hammers 28. This type of direct manual control may be accomplished by adhering the key 20 directly to the repetition lever 25, or to an intermediary key-wedge 21 to obtain the desired key angle. Even with the key-wedge interposed between the lever 25 and the key 20, the key 20 may be considered be directly attached to the lever 25, due to the lack of moving elements therebetween and fixed position relative to each other based on the fixed size of the key-wedge 21.

The key-wedge also permits the use of counterweights 22 to assist with resetting the key 20. In this inverted position, the piano action resets due to the damper spring (not shown). A heavy damper spring and counterweights 22 compensate for the effect gravity would have in the piano action's traditional orientation.

While the interior or middle of the key 20 is held in place by the repetition lever 25, the exterior end of the key 20 is restricted from lateral movement. Thus, lateral key movement is transferred to the sliding keyboard 10, 12 through key-plunge pin 23. The set-screw collar 24 on the end of the key-plunge pin 23 determines the resting level of each key 20. These components operate in conjunction with the slotted shelf 31 shown in FIGS. 3 and 4.

Figure 3:
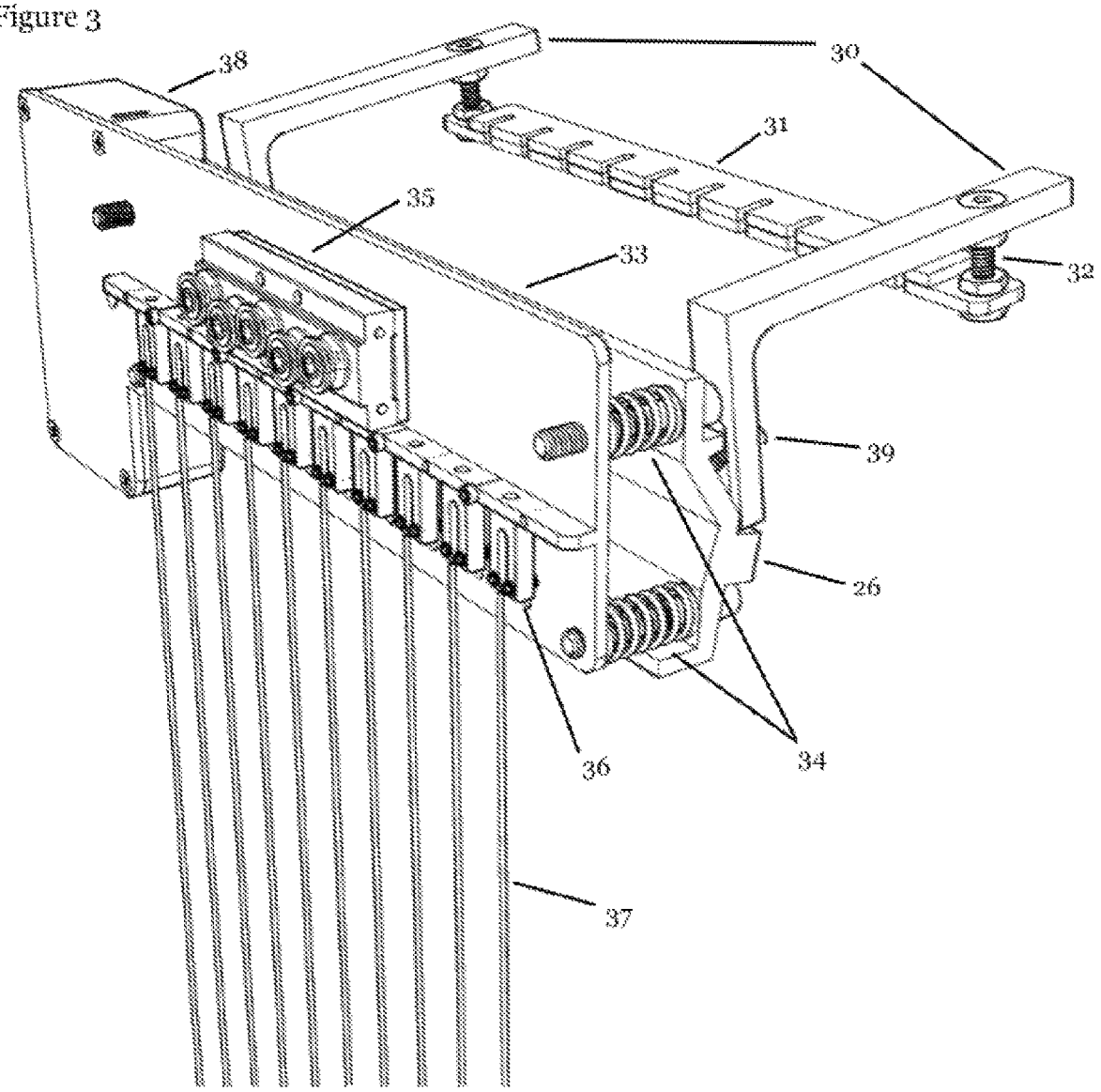
FIG. 3 is a perspective view of the action rail attached to a header carriage and a shelf support for the keys, with a plurality of strings extending downward from the action rail.

Turning now to FIG. 3, as shown, the action rail 26 is illustrated without the other components shown in FIG. 2. Attached to the hammer side of the action rail are two shelf-supports 30 supporting a slotted shelf 31, which is vertically adjustable relative to the shelf-supports 30 using screw-nut assembly 32. The shelf supports 30 attach to the action rail 26 with an angled bolt 39 and extend generally transverse to the vector 16. Attached to the damper side of the action rail 26 is header plate 33 using sprung bolts 34 extending through the action rail 26 and threaded into the header plate 33 (two other sprung screws on the opposite end are mostly blocked from view). Attached to the header plate 33 is a header carriage 35 (including roller bearings as illustrated) and a number of bridge-saddles 36 (below the carriage 35) supporting a plurality of strings 37. The bridge saddles 36 shown are commercially available electric guitar bridges with internal piezo-electric elements for converting string vibration into an electrical signal, in one aspect. The individual signals may be summed together and output from control box 38, which is also attached to the header plate 33.

Figure 4:
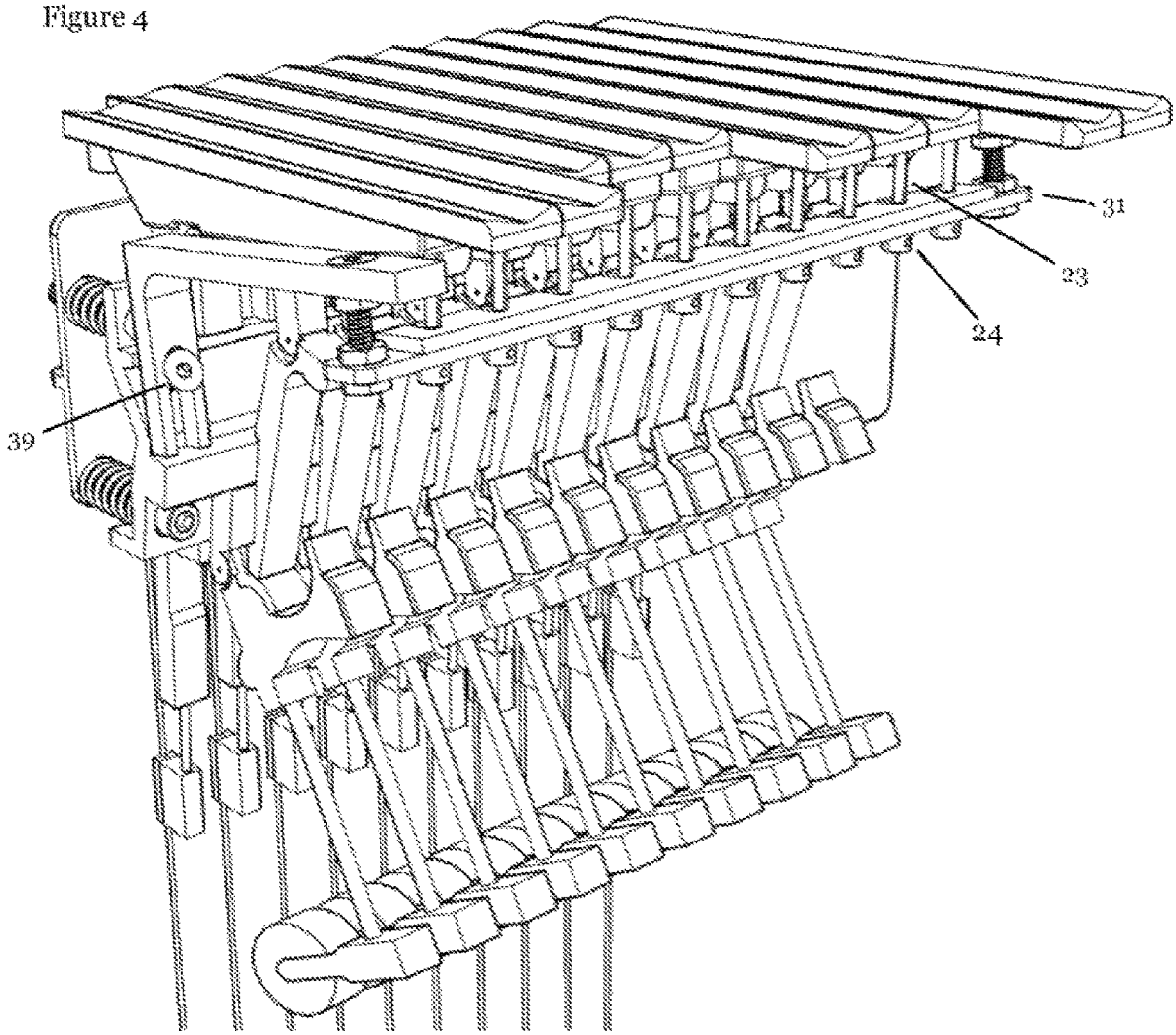
FIG. 4 is a perspective view of a plurality of the keys supported by the shelf support and coupled to the action rail.

With reference to FIG. 4, a plurality of key-action mechanisms (as detailed in FIG. 2) are shown installed on the assembly detailed in FIG. 3. The key-plunge pins 23 are shown slotted into the slots in the slotted shelf 31, thereby maintaining alignment of the keys 20, while the set-screw collars 24 limit upward key travel against the bottom of the slotted shelf 31.

The string tension is borne through a pair of header and footer plates (33 and 50, respectively). The header plate 33 (shown in FIGS. 3 and 4) attaches to the action rail 26 using four sprung bolts 34, described previously above. The sprung bolts 34 are loosely extended through the action rail 26 and threaded into the header plate 33. The upper pair of sprung bolts 34 therefore may also be used to adjust the distance between the inner ends of the keys 20 and the ruler 14, while the lower pair of sprung bolts 34 may adjust the distance between the hammers 28 and the strings 37.

Figure 6:
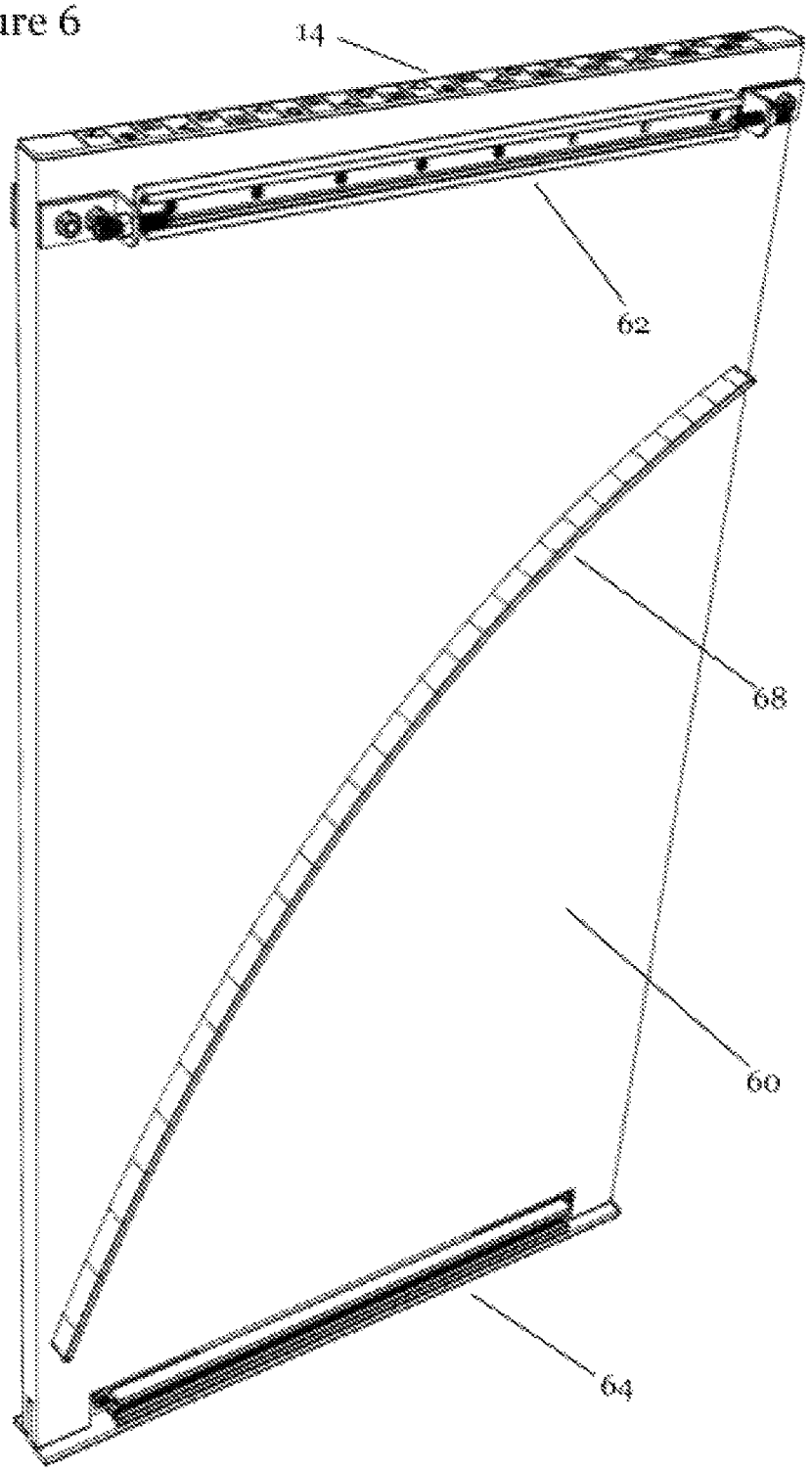
FIG. 6 is a perspective view of a support panel with support rails for supporting a header carriage and a footer carriage for sliding movement, and a curved fret configured to engage the strings.
Figure 7:
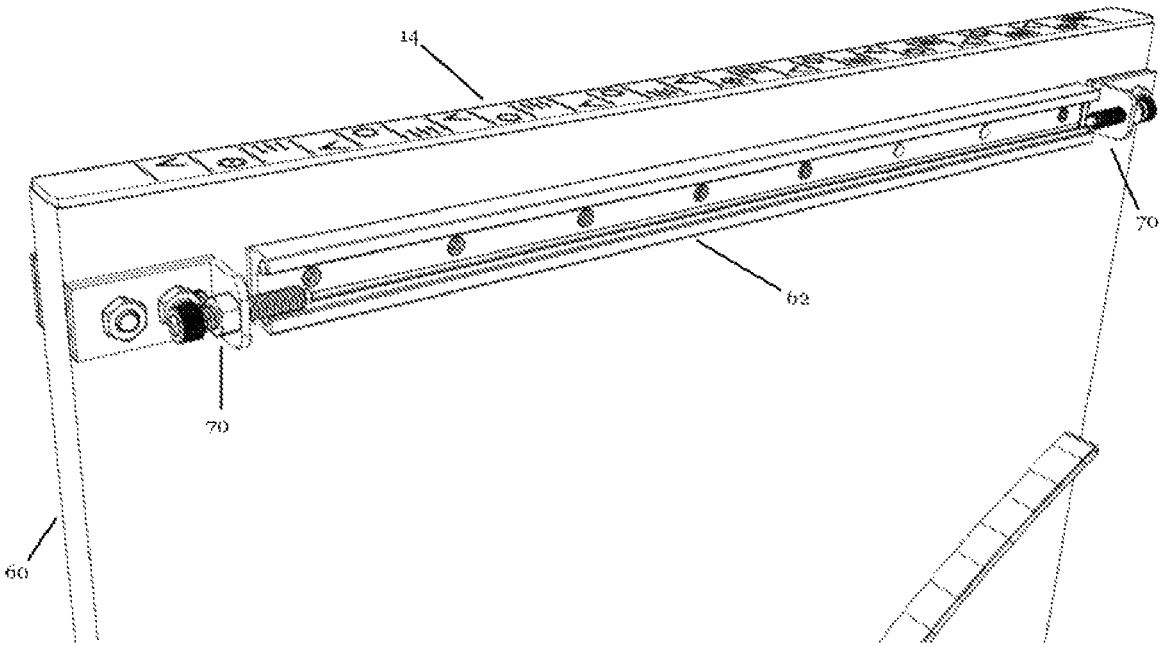
FIG. 7 is an isolated perspective view of the ruler disposed at an upper edge of the support panel.

The shelf assembly includes two shelf-supports 30 using screw-nut assembly 32 to vertically adjust slotted shelf 31. Each shelf support 30 attaches to the action rail 26 using the angled bolt 39 (better viewed in FIG. 4). The shelf assembly redirects lateral force imparted on the keys 20 (by the player pushing/pulling along vector 16) through their key-plunge pins 23 and into the slotted shelf 31. Lateral forces thereby imparted on the slotted shelf 31 impart linear motion to the header plate 33 and strings 37 shown in FIGS. 3 and 4. Header carriage 35 rolls smoothly along header rail 62 (FIGS. 6 and 7).

The ball ends of the strings 37 are slotted into holes in the header plate 33 and guided through a set of piezoelectric bridge saddles 36. The bridge saddles 36 shown in this embodiment are commercially available height-adjustable guitar bridge saddles, but other methods of supporting the strings 37 may be used. The control box 38 is included on the header plate 33 to house any additional circuitry, controls, and output jacks. Self-contained wireless embodiments are possible, or one could also use any commercially available wireless system or cable to connect to outside electrical processing and amplification. Such communication components are known and need not be described in further detail.

Figure 5:
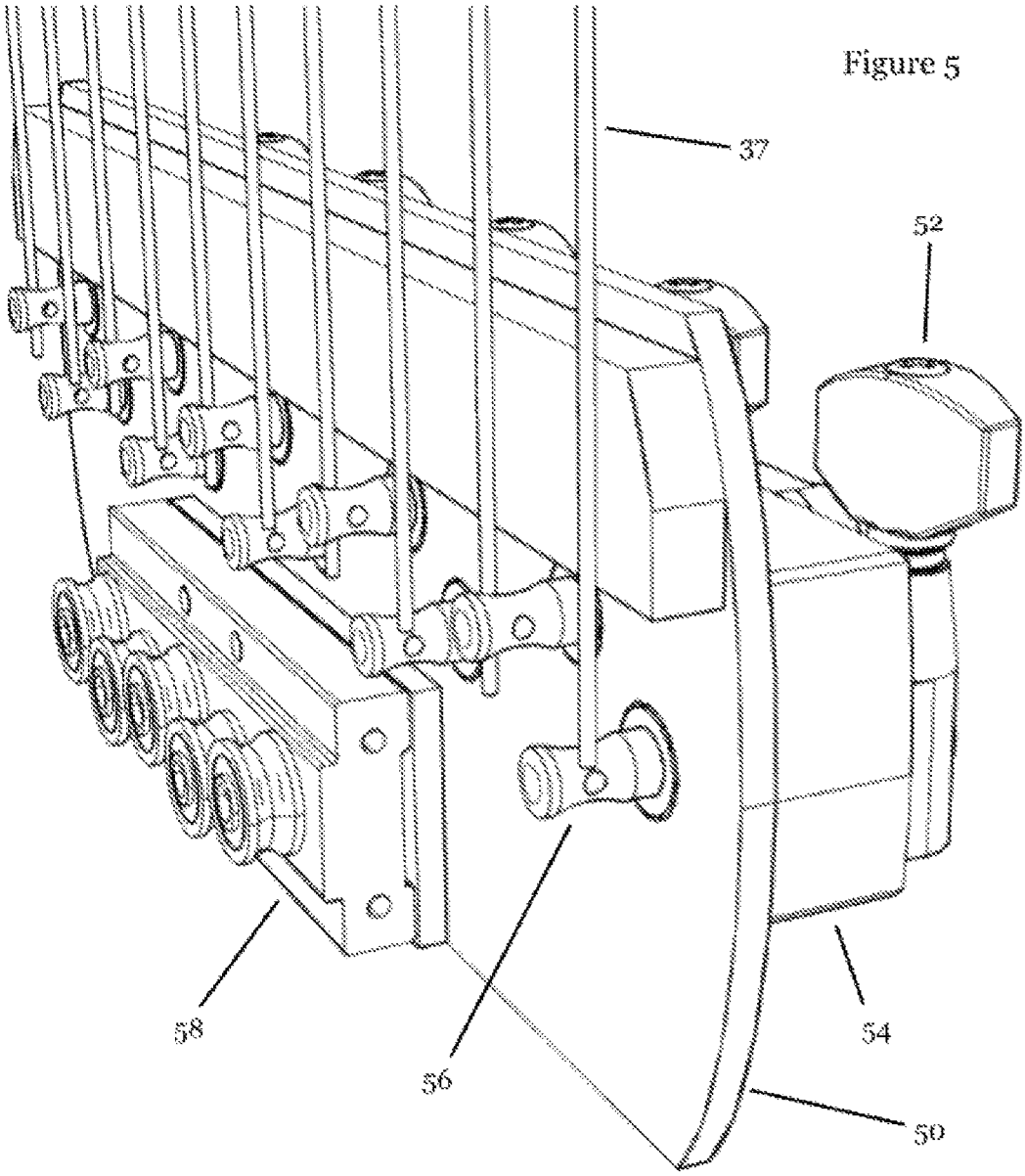
FIG. 5 is an isolated perspective view of a footer plate at an opposite end of strings from the action rail.

With reference to FIG. 5, the footer plate 50 is shown, tensioning the other ends of the strings 37 with mechanical tuning machines 52. The rotating shafts of the tuning machines 52 extend through holes in a tuner block 54 and the footer plate 50 to capture the strings at 56. A footer carriage 58 is attached to the footer plate 50 below the tuning machines. A vibration-absorbing damper block 59 damps the strings between them and the footer plate.

The end of the string 37 is terminated into the footer plate 50. The strings 37 are wrapped around the posts of commercially available guitar tuning machines 52, allowing them to be tuned. The tuner block 54 provides the required thickness to install said tuning machines. The vibration-absorbing damper block, disposed between the strings 37 and the footer plate 50, is optional. When the damper block is used it reduces the sympathetic vibration of the lower extents of the strings 37. The damper block may be composed of any appropriate foam, rubber, or felt. When the taught strings 37 are pulled by the header plate 33 assembly (in response to pushing or pulling movement by the player's fingers) the strings 37 drag the footer plate 55 assembly along with them on its footer carriage 58, which rolls in footer rail 64 (shown in FIGS. 6 and 8).

With reference to FIG. 6, a support panel 60 is shown that is strong enough to withstand the tension of the strings 37. On the top edge of the panel 60 is attached the ruler 14 (which can be attached according to a variety of methods described previously above). Along one or both faces of the panel 60 is attached header rail 62 and footer rail 64, so that header plates 33 and footer plates 50 on one or both sides of the panel 60 may travel linearly relative to the panel 60. The rails 62, 64 guide the header carriage 35 (FIG. 3) and footer carriage 58 (FIG. 5). Attached, slotted into, or formed from one or both faces of the support panel 60 is a curved fret 68. When keyboards 10, 12 are disposed on both sides of the panel 60, rails 62, 64 and curved fret 68 are disposed on both sides of the panel 60.

As shown in FIG. 6, the support panel 60 supports the string tension between the header and footer carriages 33, 58 that ride on the two mounted rails 62, 64. The support panel 60 can be composed of any material strong enough to serve its purpose, be it plywood, plastic, aluminum, composite, or any other suitably strong material. The support panel 60 may contain internal or external voids for the purpose of removing unnecessary weight. It may also attach any transport wheels or balance stands to keep the instrument upright.

The support panel 60 also mounts the curved fret 68 on any face intended to support strings; either one or both large faces of the support panel 60. In the shown embodiment the curved fret 68 is composed of a bent piece of abrasion-resistant metal inserted into a slot in the support panel 60. In another aspect, it is also possible to use a bent piece of wood, plastic, or any other suitably pliable material with a long, bent guitar fret inserted into a slot in its outer edge. The curved fret 68 may also be relief carved as an integral part of the support panel, with the abrasion-resistant fret material inserted into a slot in the crest of the carving. It will be appreciated that any strategy that allows the support panel 60 to maintain the string-contacting edge of abrasion-resistant fret 68 material at the proper height and curvature to serve its stated purpose will suffice. The precise function and geometry of the curved fret 68 will be discussed in further detail below with the further discussion of FIG. 9.

With reference to FIG. 7, the header rail 62 and ruler 14 are shown attached to the top of the support panel 60. A travel-stop bolt assembly 70 is shown at each end of the header rail 62, limiting the travel of its captured header carriage 35. Thus, the header carriage 35 cannot slide out of the rail 62 during operation. Similar travel stop assemblies may also be mounted by the footer rail 64. The header rail 62 and footer rail 64 capture the bearings of the carriages within the rail 62, 64.

FIG. 7 also illustrates one aspect of a possible embodiment of the ruler 14. There are countless possible ruler encodings that could be used to mark the position of the notes. For example, it is possible to use a ruler 14 marked with black and white stripes following the traditional piano encoding, which would be familiar to existing pianists. However, there are advantages to be had from other encodings. The shown three-symbol ruler encoding is not intended to imply that it is preferred over any other possibility. It is not necessary to choose only one encoding. The ruler 14 may or may not be removable and replaceable with alternative rulers with different encodings. This may be accomplished with screws, magnets, double-stick tape, or hook-and-loop material such as Velcro. The symbols themselves may also be carved slots through the ruler 14 so that each symbol may be lit from below by LED lights. The ruler segments, regardless of appearance or encoding, have uniform widths that generally match the uniform widths of the keys 20.

Figure 8:
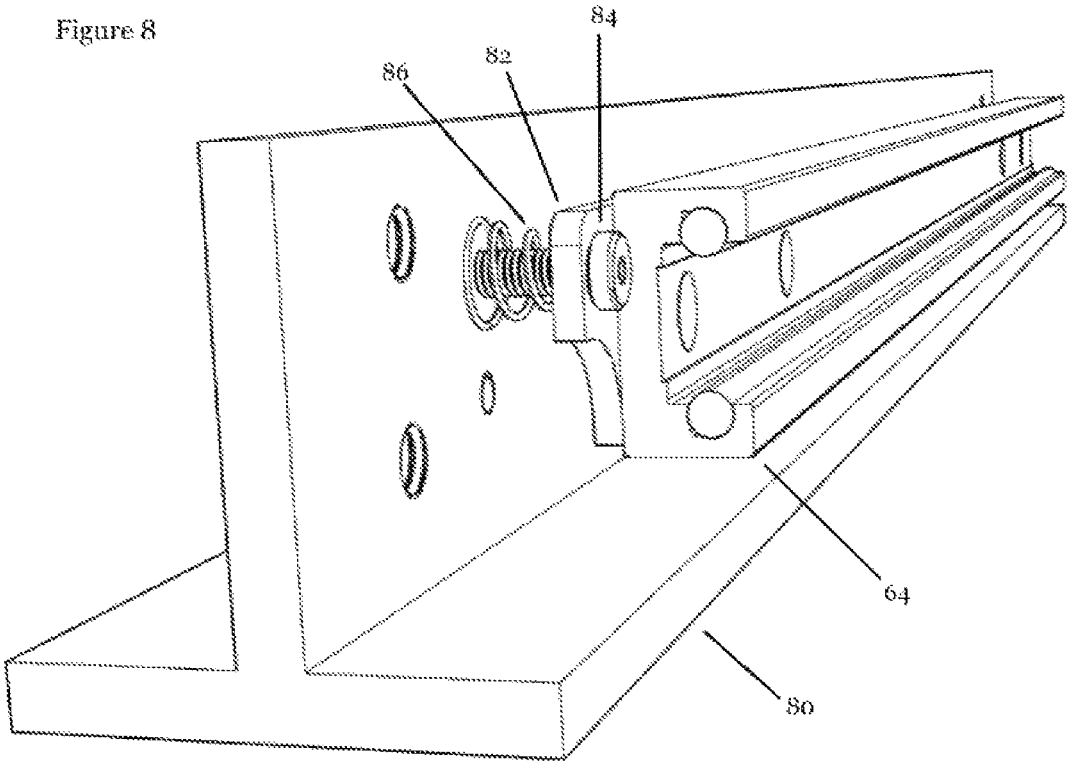
FIG. 8 is perspective view of the footer rail attached to a metal support configured to be received in the bottom edge of the support panel.

With reference to FIG. 8, the footer rail 64 is shown in further detail. In the embodiment illustrated in FIG. 8, the footer rail 64 is attached to a metal T-section beam 80, which may be arranged to slot into the bottom edge of the support panel 60. Each end of the footer rail 74 is attached to a footer rail adjustment bracket 82. A sprung adjustment bolt assembly (spring 86 and bolt 84) passes through a hole in each footer rail adjustment bracket 82 and threads into the T section beam 80, allowing each end of the rail 64 in this embodiment to be adjusted relative to the support panel 60.

It was discovered that the gauge and construction of various strings 37 used may vary the tensions of the strings 37 as they break over the curved fret 68 at different points along the slide vector 16. Accordingly, this may require adjustable compensation to preserve accurate tuning. The footer rail 64 assembly shown is one possible way to allow this compensation by varying the break angle of the strings 37 over the curved fret. Shifting the rail 64 toward the support panel 60 will increase the break angle, for example. The break angle compensation may therefore be performed by adjusting the footer rail 64 horizontally at each end. As the footer plate 50 assembly (detailed in FIG. 5) rolls along the length of the footer rail 64, the break angle of the strings over the curved fret gradually changes to correct the tuning.

Additionally, there are other ways that this adjustment can be performed. For example, it is also possible to adjust each end of the footer rail 64 vertically, compensating the strings' tension more than their break angle. This embodiment would be similar to the one shown in FIG. 8, but with the sprung bolts 82 threaded into the bottom width of the T section beam 80 rather than the center height. Put another way, the spring bolts 82 could be arranged vertically rather than horizontally to make this adjustment.

In one aspect, the T-section beam 80 is used to maintain the strength of the assembly when forming a recessed cut-away in the support panel 60 allowing room for the rails. A slot in the bottom edge of the support panel 60 (visible in FIG. 9) captures the center height of the T-section beam 80. However, in another aspect, the support panel 60 material may be strong enough such that the T-section beam 80 may not be used, and the rail 64 may be adjustably mounted to the bottom end of the panel 60 without the T-section beam 80.

Figure 9:
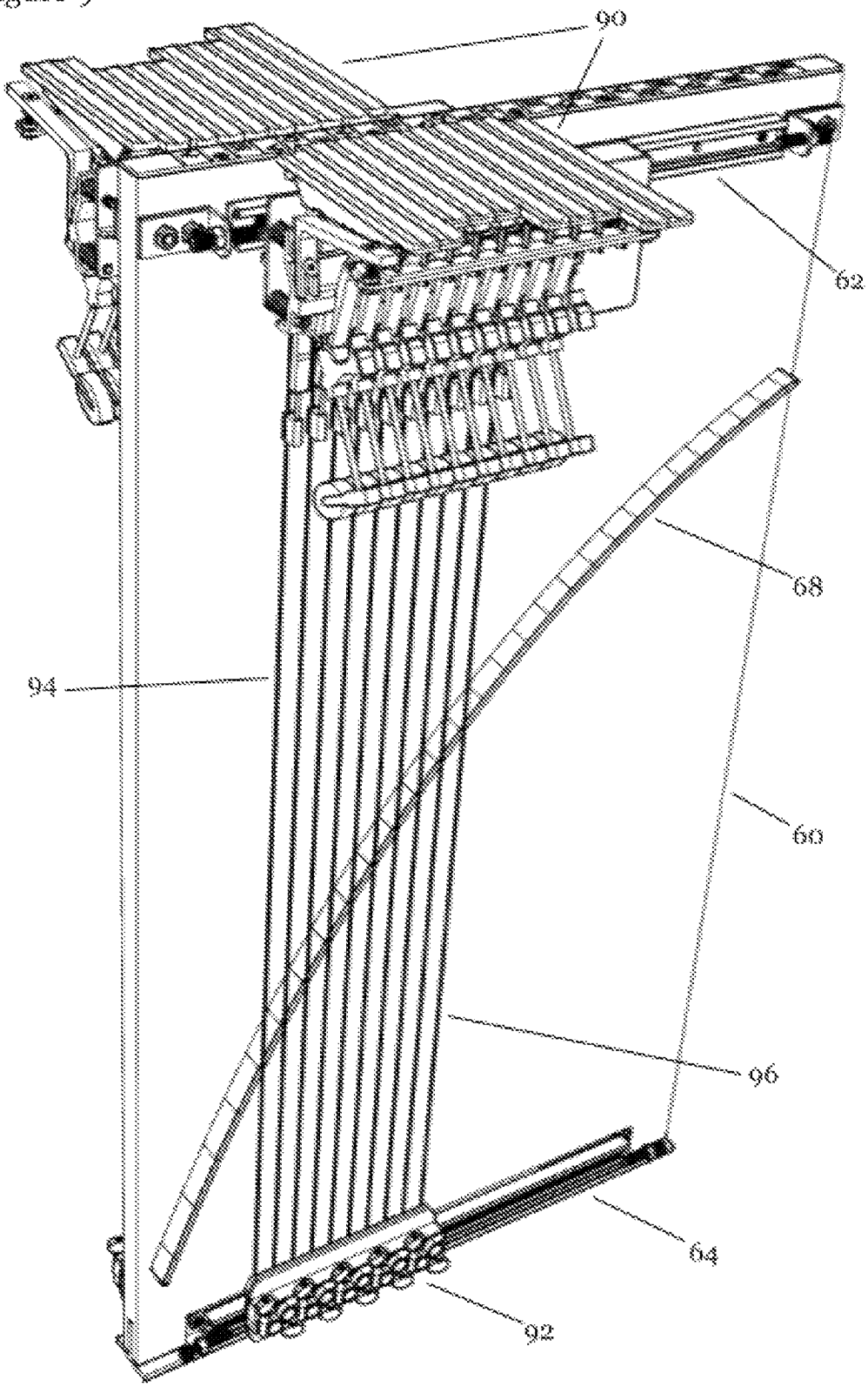
FIG. 9 is a perspective view of the human-instrument interface illustrating two slidable keyboards on opposite sides of the rulers and the strings in contact with the curved fret.

With reference to FIG. 9, dual keyboard assemblies 90 (which may also be referred to as header assemblies and may include header carriage 35 and header plate 33) the set of strings 37 with the footer assembly 92 (detailed in FIG. 5). Both assemblies are guided by their respective rails 62, 64 installed on the support panel 60. The set of strings pass over the curved fret 68 defining upper extents 94 (free to vibrate) and lower extents 96. FIG. 9 shows the discussed assemblies working together to implement a piano-action embodiment of the instrument interface. As lateral forces on either keyboard assembly 90 (two shown) cause it to roll or slide within upper rail 62, keyboard assembly 90 brings along the set of attached tensioned strings 37, which pull the footer assembly 92 along lower rail 64. The curved fret 68 is constantly in contact with the strings 37, thereby dividing the strings 37 into vibrating upper extents 94 above the curved fret 68 and lower extents 96 below the curved fret. The lower extents 96 can either be mechanically muted or left to ring sympathetically. The vibrations of the upper extents 94, which are dependent on the linear position of the string 37 on the fret 68, define the note that is produced.

As the strings 37 move along the curved fret 68 their contact points (along the length of the string 37) with the curved fret 68 change, thereby altering the lengths of their vibrating upper extents 94. Each string 37 is tuned so that the pitch of its vibrating upper extent 94 matches the note value of its corresponding articulating key 20 when aligned with a specific segment of the ruler 14. If the strings 37 are all the same gauge and construction they can all be tuned to approximately the same tension. It is also possible to tune some strings 37 so that they do not relate to their corresponding ruler segment. Such a tuning arrangement would allow the extension of the instrument's range or access to other useful harmonic elements.

The curvature geometry of the fret 68 is what allows the proper pitch transformations as the strings 37 slide along it. Because the ruler 14 segments are in constant intervals but the pitch segments are in logarithmic intervals, this curvature of the fret 68 performs the constant-to-logarithmic transformation. The curvature of the fret 68 is calculated by first deciding the maximum vibrating length L of the strings' upper extents 94 and the desired ruler 14 segment width W (corresponding to the key width). Vibrating length L is used to generate the note-to-note measurements using the same method used to calculate the fret positions on an equally tempered guitar. The standard procedure to make a twelve-tone equal-tempered instrument is to divide L by the constant 17.817 (the inverse of the 12th root of 2). This results in the distance along the string 37 to the first note. Subtract that value from L and use the result to repeat the process until you have calculated enough notes to cover the range of the instrument. Plot your calculated distance measurements with dots along a vertical line. Then sequentially shift each dot perpendicular to the line a distance W relative to its adjacent dot. Finally, smoothly connect the dots to draw the specific curvature of the fret 68. Thus, the curved fret 68 can be created according to the specific needs of the player, if desired.

While many details have been revealed in this document many other variations are possible. In one aspect, any number of sliding keyboards 10, 12 may be used. In another aspect, the keyboards 10, 12 may slide in alternative directions. In one aspect, different surfaces may be used for controlling keyboard movement. In one aspect, angled or shaped keys 20 may be used to improve ergonomics. In one aspect, alternate key arrangements and/or ruler layouts may be used. In one aspect, various manners of controlling the string volume envelope may be used. Embodiments with different pickups or without any electric pickups may be used. Embodiments with one or more acoustic soundboards may be used. Embodiments with keyboards moving along the same side of the ruler may be used (mentioned previously above). Embodiments using haptic feedback indicating per-segment keyboard movement may be used. Embodiments using magnets to encourage discrete key-ruler segment alignment may be used. Embodiments using keys with alternate shapes, colors, markings, or textures may be used. Embodiments using different materials than those disclosed may be used. Embodiments using alternate methods of causing string vibration may be used. Embodiments using alternate methods of attaching and detaching the ruler from the panel may be used. Embodiments simplifying alignment and setup may be used. Embodiments using various types of support stands may be used. Embodiments with cavities or depressions to reduce the support panel's weight may be used. Embodiments based on non-equally tempered or non-diatonic scales may be used. Embodiments containing electrical sound amplification mechanisms may be used.

It will be appreciated that the many variations of the above are possible, and that the above descriptions are exemplary, and that scope of the invention does not necessarily include the illustrative details described above.

What is claimed is:

1. A musical instrument comprising:

an elongate ruler extending between opposite ends and defining a vector therebetween;

at least one sliding keyboard assembly slidably coupled to the elongate ruler and slidably moveable along the vector relative to the elongate ruler;

wherein the keyboard assembly includes a plurality of keys arranged adjacent each other in the direction of the vector;

wherein the ruler includes a plurality of segments having a common segment width;

where the keys have a width corresponding to the common segment width of the ruler;

wherein each of the keys are configured to generate a note, wherein the note generated is dependent on the segment of the ruler aligned with the key;

wherein slidable movement of the keyboard relative to the ruler alters the note generated by each key.

2. The musical instrument of claim 1, wherein the ruler is attached in a fixed position to an upper edge of a support panel, and the keyboard is slidably attached to the support panel.

3. The musical instrument of claim 2, wherein the keyboard slides relative to the support panel via roller bearings.

4. The musical instrument of claim 2, wherein the ruler is removable and replaceable relative to a support panel, such that further rulers can be installed on the panel.

5. The musical instrument of claim 1, wherein a pair of sliding keyboards are slidably coupled to the ruler.

6. The musical instrument of claim 5, wherein the pair of sliding keyboards are disposed on opposite lateral sides of the ruler.

7. The musical instrument of claim 6, wherein each of the keyboards of the pair of keyboards have a key layout, and the key layout of each of the keyboards is the same.

8. The musical instrument of claim 1, wherein the keys of the at least one keyboard extend perpendicular relative to the vector.

9. The musical instrument of claim 1, wherein each of the keys are coupled to a header plate, wherein the header plate slides relative to the ruler and carries the keys.

10. The musical instrument of claim 9, wherein each of the keys are actuated relative to an action plate and supported by the action plate, wherein the action plate is disposed between the keys and the header plate.

11. A musical instrument comprising:

a plurality of strings extending between an upper carriage and a lower carriage, the upper carriage and lower carriage translatable along a support structure in a direction parallel to a first vector;

a curved fret coupled to the support structure, the curved fret defining a curvature relative to the vector;

wherein each of the plurality of strings are in contact with the curved fret at a contact point, wherein for each string contact with the curved fret defines an upper extent above the contact point a lower extent below the contact point of the string and the curved fret;

wherein the upper carriage and the lower carriage are translatable relative to the ruler and the curved fret along the vector, wherein translation of the upper and lower carriages and the strings alters the upper extent and the lower extent for each of the strings.

12. The musical instrument of claim 11, wherein the support structure is a support panel.

13. The musical instrument of claim 12, wherein the support panel includes a curved recess corresponding to the curved fret, and the curved fret is mounted in the recess.

14. The musical instrument of claim 12, wherein the upper and lower carriages translate along rails mounted to the support panel, wherein the rails extend parallel to the first vector.

15. The musical instrument of claim 12, wherein the plurality of strings are spaced apart at a common distance relative to each other.

16. The musical instrument of claim 15, further comprising an elongate ruler extending along the first vector, wherein the segments are spaced at the common distance of the strings.

17. The musical instrument of claim 11, wherein the length of the upper extent varies logarithmically at a given linear change in distance along the first vector.

18. A musical instrument comprising:

an elongate ruler extending along a vector and defining a plurality of sectors;

a curved fret defining a curvature and fixed relative to the elongate ruler;

an upper rail and a lower rail disposed above and below the curved fret; the upper and lower rail configured to support a string in tension therebetween, wherein contact between the string and the curved fret defines an upper extent of the string extending between the curved fret and the upper rail and a lower extent of the string extending between the curved fret and the lower rail;

wherein at least one of the upper rail and the lower rail are adjustable relative to the curved fret, wherein adjustment of the upper rail or the lower rail adjusts a break angle of the string over the curved fret or a string tension of the string at any point along the curved fret.

19. The musical instrument of claim 18, wherein the upper rail or lower rail are adjustable in a lateral direction.

20. The musical instrument of claim 18, wherein the upper rail or lower rail are adjustable in a vertical direction.

* * * * *